US011280181B2

(12) United States Patent
Stein

(10) Patent No.: US 11,280,181 B2
(45) Date of Patent: Mar. 22, 2022

(54) METHOD AND SYSTEM FOR INTEGRITY TESTING

(71) Applicant: Interwell Norway AS, Hafrsfjord (NO)

(72) Inventor: Arild F. Stein, Sandnes (NO)

(73) Assignee: Interwell Norway AS, Hafrsfjord (NO)

( * ) Notice: Subject to any disclaimer, the term of this patent is extended or adjusted under 35 U.S.C. 154(b) by 12 days.

(21) Appl. No.: 16/623,235

(22) PCT Filed: Jun. 12, 2018

(86) PCT No.: PCT/EP2018/065474
§ 371 (c)(1),
(2) Date: Dec. 16, 2019

(87) PCT Pub. No.: WO2018/229042
PCT Pub. Date: Dec. 20, 2018

(65) Prior Publication Data

US 2020/0182048 A1 Jun. 11, 2020

(30) Foreign Application Priority Data

Jun. 16, 2017 (NO) ..... 20170995

(51) Int. Cl.
*E21B 47/117* (2012.01)
*E21B 47/06* (2012.01)
(Continued)

(52) U.S. Cl.
CPC ..... *E21B 47/117* (2020.05); *E21B 47/06* (2013.01); *E21B 47/10* (2013.01); *E21B 33/12* (2013.01);
(Continued)

(58) Field of Classification Search
CPC ..... E21B 47/117; E21B 47/10; E21B 47/06; E21B 47/005
See application file for complete search history.

(56) References Cited

U.S. PATENT DOCUMENTS 4,519,238 A 5/1985 Hailey
4,718,496 A 1/1988 Tompkins et al.
(Continued)

FOREIGN PATENT DOCUMENTS

EP 2728111 A1 5/2014
WO 2006/062512 A1 6/2006

OTHER PUBLICATIONS

International Search Report issued in Application No. PCT/EP2018/065474, dated Oct. 19, 2018 (6 pages).
(Continued)

*Primary Examiner* — Catherine Loikith
(74) *Attorney, Agent, or Firm* — Finnegan, Henderson, Farabow, Garrett & Dunner, LLP

(57) ABSTRACT

A method for testing an integrity of a primary barrier arranged in a well includes arranging a first sealing device above the primary barrier in a position axially spaced from the primary barrier in the well, which establishes a test chamber confined by the first sealing device and the primary barrier. The method further includes arranging a second sealing device above the first sealing device in a position axially spaced from the first sealing device in the well, which establishes a further test chamber between the first sealing device and the second sealing device. The method also includes reducing a pressure of the test chamber to a predetermined test pressure, monitoring the pressure of the test chamber and a pressure of the further test chamber after the pressure reduction, and verifying the integrity of the primary barrier if no pressure increases or decreases are detected in the test chamber after the applied pressure reduction.

14 Claims, 6 Drawing Sheets

(51) Int. Cl.

| | |
|---|---|
| ***E21B 47/10*** | (2012.01) |
| ***E21B 47/005*** | (2012.01) |
| *E21B 33/12* | (2006.01) |
| *E21B 33/13* | (2006.01) |

(52) U.S. Cl.
CPC ..... *E21B 33/13* (2013.01); *E21B 47/005* (2020.05); *E21B 2200/04* (2020.05); *E21B 2200/06* (2020.05)

(56) References Cited

U.S. PATENT DOCUMENTS

| | | | |
|---|---|---|---|
| 2005/0028980 | A1 | 2/2005 | Page et al. |
| 2015/0159480 | A1 | 6/2015 | Kalyanaraman et al. |
| 2015/0204155 | A1 | 7/2015 | Patel |
| 2015/0361782 | A1 | 12/2015 | Kjorholt et al. |

OTHER PUBLICATIONS

Written Opinion issued in International Application No. PCT/EP2018/065474, dated Oct. 19, 2018 (8 pages).
Search Report issued in Norwegian Application No. 2017995, dated Nov. 11, 2017 (2 pages).

METHOD AND SYSTEM FOR INTEGRITY TESTING

FIELD

One or more embodiments of the present invention relates to method for testing the integrity of a primary barrier and a system for testing the integrity of a barrier arranged in a well. In particular, one or more embodiments of the present invention relate to testing an installed well barrier, both permanent and temporary barriers from an upper side of the barriers.

The terms "upper". "above", "below" and "lower" is used in the document to define positions in a well. "Upper" and "above" in the context of this document mean closer to the well opening and "lower" further away from the well opening. These terms apply both when the well has a vertical and horizontal orientation.

The test method and system as described herein is applicable for a well in a geological formations such as a downhole environment.

BACKGROUND

Barriers installed in wells need to be tested and according to requirement set by the asset owner or/and official regulations as set by national authorities. The barriers should be tested in the direction of flow. This to ensure that the barriers are able to withstand the load expected to be exerted on to the barrier.

One or more embodiments of the invention may be used for temporary plugging, in asset securement and for plug and abandonment (P&A) of wells, for permanently sealing of well such as abandoned wells.

Permanent barriers are typically employed for the terminal closing of wells. There are several means and procedures for closing of the wells, both traditionally well known means and more novel approaches. All with the same intention to enclose the pressurized zone below the barrier in compliance with the regulatory demands in the region of the asset.

Permanent or temporary barriers are established across the full cross-section of the well, or if installed in a bore of a well tubular, across the full cross section of the well tubular bore, in order to isolate the well zone below the barrier.

Requirements as set by the asset owner and/or regulated by national authorities may demand that the installed barrier, whether employed in an abandoned well or in a working well, ensures sealing integrity in a prespecified axial distance of the well. An inadequate sealing of the barrier in the well represents a serious risk and thus it is necessary to carry out procedure to check and verify that the barrier is properly installed and sealed in accordance with these requirements. As it may be difficult to perform an accurate assurance and verifying of the quality of the barriers, acceptance criteria's for measuring the sealing quality of the barriers thus are often set by quite large margins.

Several methods have been proposed to get a proper inflow test with forces applied from below the installed barrier when reducing surface pressure is not possible (mainly due to hydrostatic pressure). And amongst these one approach to such testing of barrier integrity is installing necessary testing equipment in a position below the permanent barrier for the later pressure testing of the barriers sealed engagement with the formations. The testing equipment is arranged to produce a test pressure working on the permanent barrier from below the permanent barrier and as such apply a test pressure that coincide with the flow direction towards the environment. When pressure testing in accordance with this approach, the testing equipment needs to be in place before installing the permanent barrier and as the testing equipment is placed below the permanent barrier, the testing equipment is not later retrievable and needs to be abandoned in the installed position.

In addition to the obvious disadvantage of abandoning the testing equipment in the well, the decay of a well being at the end of its life span has an undesirable effect when pressure testing is conducted within the sealed off part of the well. Necessary test pressure may exceed pore pressure in the formation and structural strength within the well construction and may in worst case cause fracturing. Hence, one or more embodiments of the invention may be able to perform the pressure manipulation test at depth without increasing the pressure in the entire well above the primary barrier.

US 2015/0361782 A1 method includes forming two or more plugs within the well, the plugs being formed at longitudinally spaced apart locations whilst providing a fluid communication path from a region above the topmost plug to the or each space between adjacent plugs. This configuration facilitates pressure testing of one or more of the plugs by conducting fluid through said path. Such a fluid path through a plug is normally not accepted, as this is considered as a breach of the barrier formed by the plug.

US 2015/0204155 A1 describes a dual barrier with a shallow set barrier and a deep set barrier. A monitoring system is monitoring the pressure between the barriers.

US 2005/0028980 A1 describes a method of suspending a well comprising the steps of: providing a first barrier in the well; verifying the integrity of the first barrier; thereafter providing at least a second barrier in the well above the first barrier defining a space between the first and second barriers; and, verifying the integrity of the second barrier. This dual barrier system also comprises a pressure measuring means for generating a signal indicative of the pressure in the space between the first and second barriers.

US 2015/0159480 describes a method of testing a barrier in a wellhole. The barrier can be a bridge plug, a cement plug, shoe track cement, float collar, a frac plug, or the like. An apparatus with a body having a chamber and an isolation device is lowered into the wellbore. The chamber is in fluid communication with an isolated volume between the barrier and the isolation device on the apparatus. The volume of the chamber can be changed and pressure changes due to volume changes can be monitored. The example method also includes performing a pressure test on the barrier. The pressure test can be performed by adding test fluid to the volume between the barrier and the isolation device or removing wellbore fluid from the volume between the isolation device and the barrier. A pump is used to adding or reducing test fluid. There is no pressure testing of the isolation device itself. One or more embodiments of the present invention may alleviate the above-described disadvantages of the prior art testing approaches and to provide an alternative to these prior art approaches.

One or more embodiments of the present invention may be used for testing various barriers both temporary and permanent barriers, retrievable and non-retrievable, and which employs the accessible upper side of the barrier for pressure testing.

One or more embodiments may utilize easy accessible equipment for carrying out the pressure testing and may use equipment that may be retrieved when the pressure testing is completed and which is reusable at other locations later.

One or more embodiments of the present invention may be able to perform the pressure test without pumping well fluids from surface or at installation depth.

One or more embodiments of the present invention may be able to reuse the equipment used for the pressure test, even if the pressure used for testing will vary from well to well.

SUMMARY

One or more embodiments of the invention may be defined in the independent claims. Further additional features are set forth in the dependent claims.

One or more embodiments of the invention may concern a method for testing the integrity of a primary barrier arranged in a well, wherein the method comprises the following steps:

a) arranging a secondary seal above the primary barrier in a position axially spaced from the primary barrier in the well thereby establishing a test chamber confined by the secondary seal and the primary barrier, b) testing and verifying the integrity of the secondary seal c) reducing the pressure of the test chamber to a predetermined test pressure TP2 d) monitoring the pressure of the test chamber after the pressure reduction.

The test chamber is also confined by the side walls of the well between the primary barrier and the secondary seal. The side walls of the well may be the side walls of a casing pipe, the side walls of a cement structure, the side walls of a formation structure or the side walls of the cement walls, i.e. the material in which the primary barrier has been set.

In one or more embodiments step c) of the inventive method may comprise the step of:

calculating the predetermined test pressure TP2 of the test chamber based on a required load for instance pressure acting on the primary barrier from below.

In one or more embodiments step b) of the inventive method may comprise the step of:

increasing the pressure above the secondary seal to a predetermined test pressure TP1;

monitoring the pressure of the test chamber during the pressure increase to the predetermined test pressure TP1.

In one or more embodiments step b) may further comprises verifying the integrity of the secondary seal if no pressure rise is detected in the test chamber after the pressure increase above the secondary seal.

In one or more embodiments step d) may further comprise verifying the integrity of the primary barrier if no pressure rise is detected in the test chamber after the applied pressure reduction, verifying a failed integrity of the primary barrier if a pressure rise is detected in the test chamber.

In one or more embodiments step d) may further comprise measuring the pressure of the test chamber by sensor means arranged in the test chamber and communicating the information about measurements from the test chamber to a memory and/or transmitting the information to a top side or remote location.

In one or more embodiments step a) further comprises selecting the position of the secondary seal to provide a predetermined test chamber volume.

In one or more embodiments step d) may comprise calculating the size of the volume of fluid to be removed from the test chamber volume to reduce the pressure of the test chamber to the predetermined test pressure TP2.

In one or more embodiments step b) may comprise the step of:

arranging an additional test seal above the secondary seal in a position axially spaced from the secondary seal in the well thereby establishing a closed volume secondary test chamber confined by the additional test seal and the secondary seal.

In one or more further embodiments of establishing this secondary test chamber the method for testing further comprising the steps of:

increasing or reducing the pressure in the enclosed secondary test chamber to a predetermined test pressure TP1;

monitoring the pressure of the test chamber during or after the pressure increase or pressure reduction.

One or more embodiments of the invention may also concern a system for testing integrity of a primary barrier arranged in a well. The system comprises a secondary seal provided for arrangement above the primary barrier in a position axially spaced from the primary barrier for establishing a confined test chamber between the secondary seal and the primary barrier, a pressure testing device configured for testing and verifying the integrity of the secondary seal.

a pressure reducing device configured for reducing the pressure of the test chamber to a predetermined test pressure TP2, a monitoring arrangement arranged for surveying the pressure of the test chamber after the pressure reduction.

In one or more embodiments the primary barrier may comprise a permanent barrier provided for sealing engagement with the formations surrounding the well.

In one or more embodiments the secondary seal and/or primary barrier may comprise a plug arranged for installment in the well.

In one or more embodiments the primary barrier may comprise a first radial expandable element and the secondary seal may comprise a second radial expandable element. The first radial expandable element and second radial expandable element are optionally arranged on a setting tool for installment in the well.

In one or more embodiments an additional test seal may be arranged above the secondary seal in a position axially spaced from the secondary seal in the well for establishing a secondary test chamber confined by the additional test seal and the secondary seal. The secondary seal may comprise a first radial expandable element and the additional test seal may comprise a second radial expandable element. The first radial expandable element and the second radial expandable element may optionally be arranged on a setting tool for installment in the well.

These and other characteristics of one or more embodiments of the invention will be clear from the following description of one or more exemplary embodiments, given as a non-restrictive example, with reference to the attached drawings.

One or more embodiments of the present invention may further relate to a method for testing the integrity of a primary barrier arranged in a well, wherein the method comprises the following steps:

a) arranging a first sealing device above the primary barrier in a position axially spaced from the primary barrier in the well, thereby establishing a test chamber confined by the first sealing device and the primary barrier;

b) arranging a second sealing device above the first sealing device in a position axially spaced from the first sealing device in the well, thereby establishing a further test chamber between the first sealing device and the second sealing device:

c) reducing the pressure of the test chamber to a predetermined test pressure;

d) monitoring the pressure of the test chamber and the further test chamber after the pressure reduction:

e) verifying the integrity of the primary barrier if the following conditions are fulfilled:

no pressure increase is detected in the test chamber after the applied pressure reduction; and no pressure decrease is detected in the further test chamber after the applied pressure reduction.

Initially, before the verification, the test chamber is filled with a gas with atmospheric pressure. However, it should be noted that it is sufficient that the test chamber is filled with a gas with a pressure substantially lower than the well pressure at testing depth.

In one aspect, the method further comprises the step of:

retrieving the first sealing device and the second sealing device from the well after step e).

In one aspect, the step of reducing the pressure of the test chamber comprises the step of:

providing the first sealing device with a tank device having a chamber filled with a gas with a pressure lower than the pressure in the well;

establishing fluid communication between a chamber of a tank device and the test chamber.

In one aspect, the step of providing the first sealing device with a tank device having a chamber filled with a gas with a pressure lower than the pressure in the well comprises the step of:

establishing fluid communication between the chamber of the tank device and the topside surroundings, before the first sealing device is lowered into the well;

closing the fluid communication to the chamber topside, before the first sealing device is lowered into the well.

In one aspect, the method further comprises the steps of:

verifying a failed integrity of the primary barrier if a pressure increase is detected in the test chamber after the applied pressure reduction; and/or verifying a failed integrity of the second sealing device if a pressure decrease is detected in the further test chamber after the applied pressure reduction.

One or more embodiments of the present invention may also relate to a system for testing integrity of a primary barrier arranged in a well; wherein the system comprises:

a first sealing device provided for arrangement above the primary barrier in a position axially spaced from the primary barrier for establishing a confined test chamber between the first sealing device and the primary barrier;

a second sealing device provided for arrangement above the first sealing device in a position axially spaced from the first sealing device for establishing a further confined test chamber between the first sealing device and the second sealing device;

a pressure reducing device configured for reducing the pressure of the test chamber to a predetermined test pressure;

a monitoring arrangement comprising a first sensor and communication device arranged for surveying the pressure of the test chamber after the pressure reduction and a second sensor and communication device arranged for surveying the pressure of the further test chamber after the pressure reduction;

a pressure testing device provided in communication with the first and second sensor and communication devices, where the pressure testing device is configured for testing and verifying the integrity of the first sealing device and the integrity of the primary barrier.

Initially, before the verification, the test chamber is filled with a gas with atmospheric pressure.

Also the further test chamber is confined axially between the first sealing device and the second sealing device. In addition, the environment in which the first sealing device and the second sealing device have been set in, such as the casing, is considered as a part of that confinement.

In one aspect, the pressure testing device is configured to verify the integrity of the primary barrier if the following conditions are fulfilled:

no pressure increase is detected in the test chamber after the applied pressure reduction; and no pressure decrease is detected in the further test chamber after the applied pressure reduction.

In the same way as in the method above, the pressure testing device is configured to verify a failed integrity of the primary barrier if a pressure increase is detected in the test chamber after the applied pressure reduction; and/or the pressure testing device is configured to verify a failed integrity of the second sealing device if a pressure decrease is detected in the further test chamber after the applied pressure reduction.

In one aspect, the pressure reducing device comprises:

a fluid tank housing with a fluid compartment;

a fluid line providing fluid communication between the outside of the housing and the fluid compartment;

a valve arrangement provided in the fluid line.

In one aspect, the pressure testing device is configured to control the valve.

In one aspect, the pressure reducing device comprises:

a nose section releasably connected to the housing for providing access to the fluid compartment;

a volume reducing insert inserted into the fluid compartment for reducing the volume of the fluid compartment.

According to the above, it is achieved that the same pressure reducing device can be re-used for testing primary barriers in other wells, even if the reduction of volume needed for pressure testing of these primary barriers are different.

According to the above, it is also achieved that the separate operation of pressure testing of the further test chamber, either by increasing the pressure in the further test chamber or by decreasing the pressure in the further test chamber, can be avoided.

In one aspect, the first and second sealing devices are mechanically connected to each other and are set during one run.

DETAILED DESCRIPTION

Figure 1:
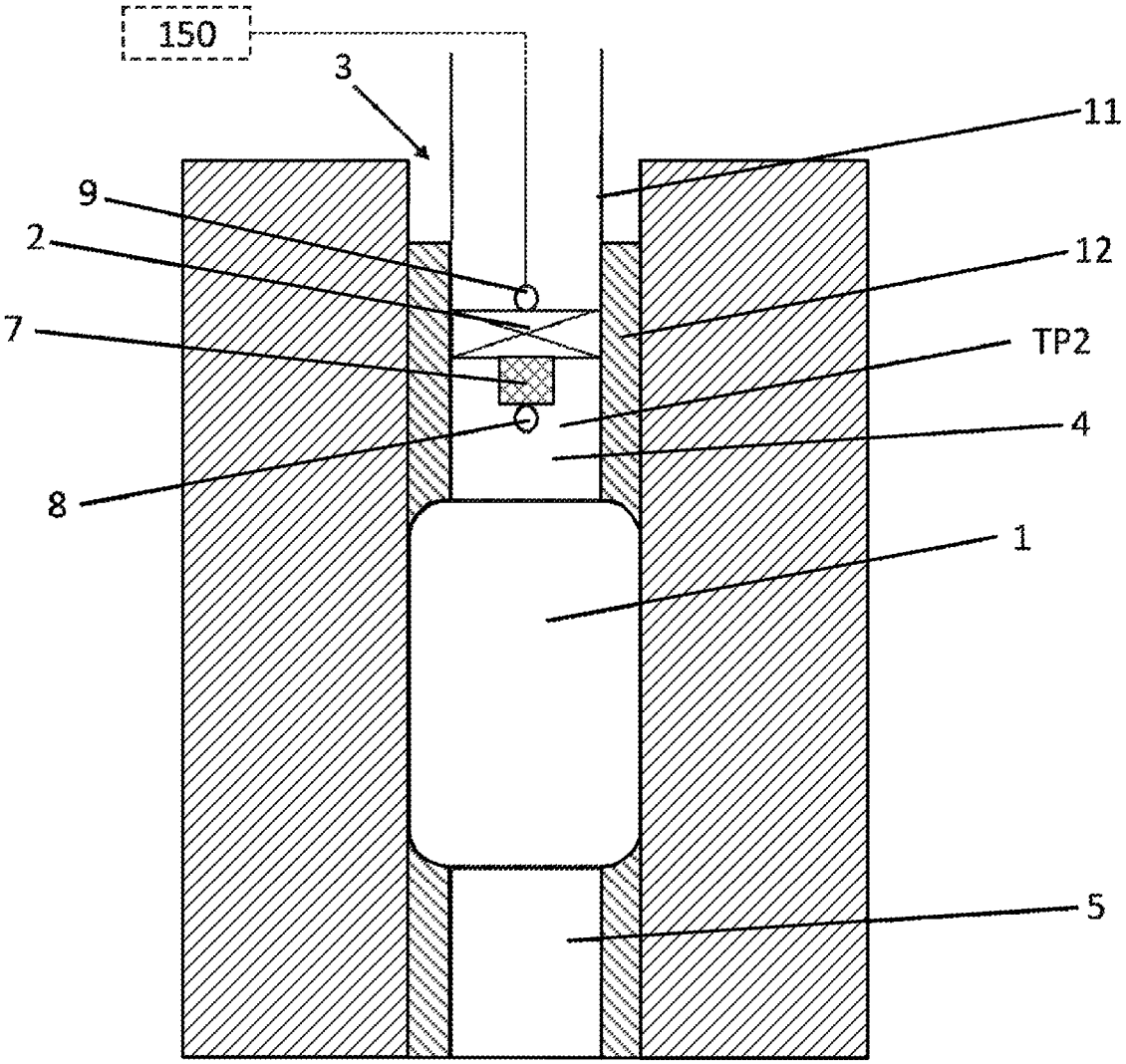
FIG. 1 is a cross sectional side view illustrating the main principles of an initial installation of the test equipment over a perforated wash and cement squeeze type installed primary barrier.
Figure 2:
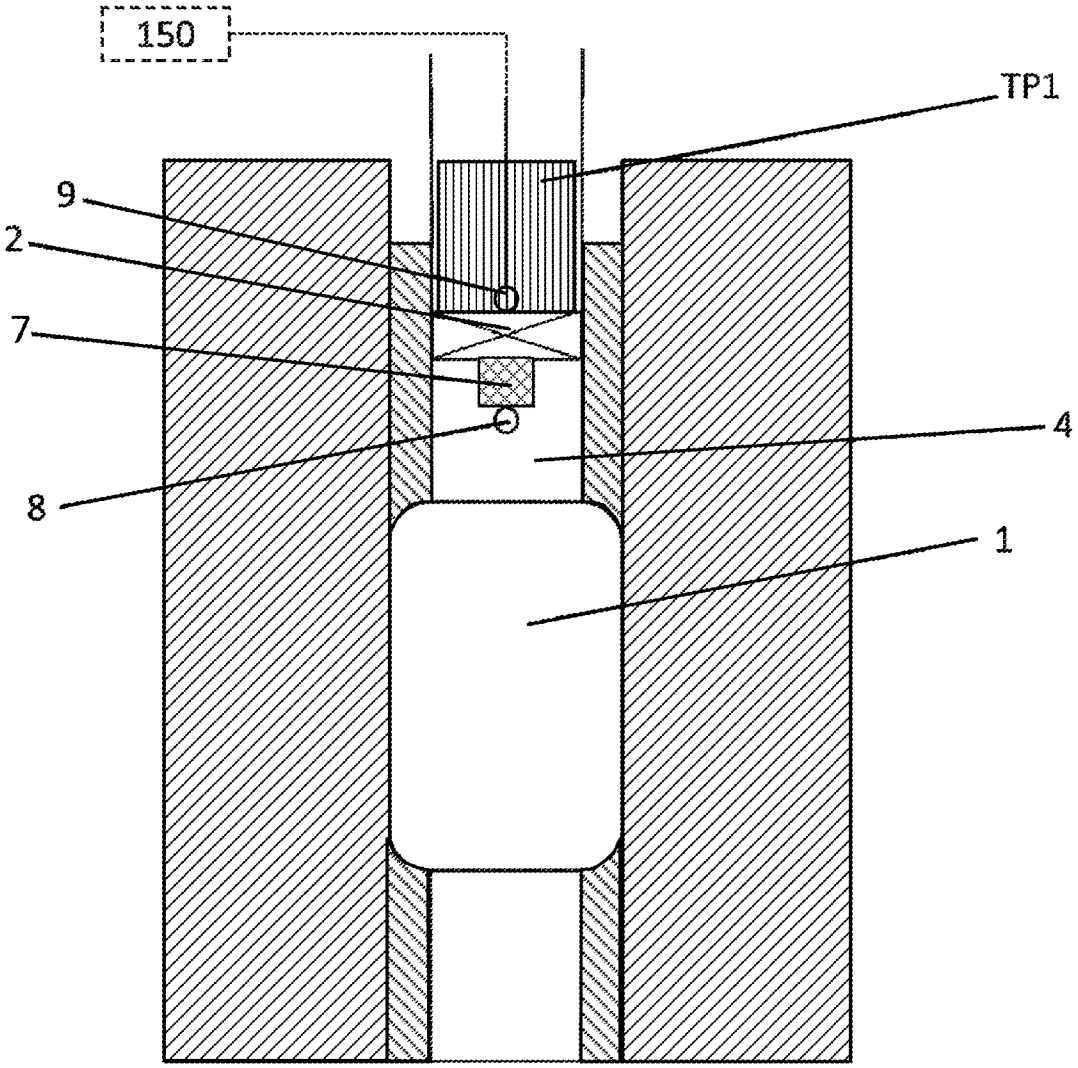
FIG. 2 is a cross sectional side view illustrating the main principles of a pressure testing of a secondary seal over a perforated wash and cement squeeze type installed primary barrier.
Figure 3:
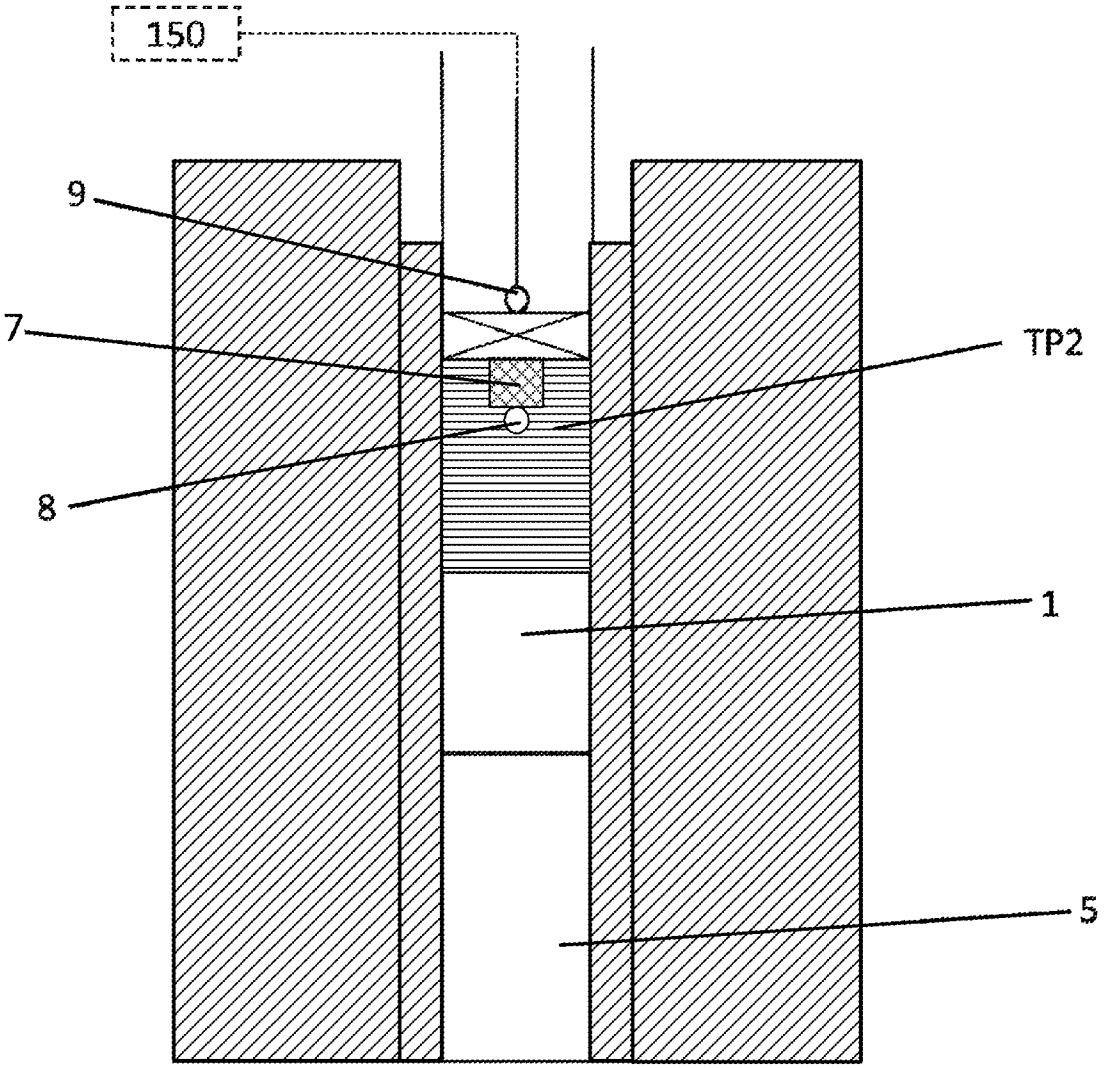
FIG. 3 is a cross sectional side view illustrating the main principles of a pressure testing of a primary barrier over a casing removal and cement squeeze type installed primary barrier.

FIGS. 1-3 illustrates an example of one or more embodiments of the invention showing a primary barrier 1 installed in a well. A primary barrier 1 as illustrated is provided as a permanent barrier of cement in sealing engagement with a cement sheath 12. The cement sheath establishes fundamentation between a casing 11 and the formations surrounding the well. The shown arrangement closes off a volume 5 below the primary barrier 1 and illustrates a typical set up for a deserted well that is prepared for abandonment.

As an alternative to the set up shown in FIG. 1-2 a permanent cement barrier may be installed where a milled out window have removed the casing 11 and reestablished a primary barrier with a cement squeeze. A more novel installation process may melt the outer casing by employing a heating process for potting the primary barrier to the surrounding formations in order to produce a continuous seal between the barrier and the surrounding formations.

FIG. 1 shows a secondary seal 2 positioned above the primary barrier 1 in an axial distance from the primary barrier 1 to provide a test chamber 4 between the primary barrier 1 and the secondary seal 2. The secondary seal 2 may comprise a temporary barrier such as the illustrated element or any other retrievable device provided for sealing engagement in a well pipe such as for instance a casing or alternatively in direct sealing engagement with the wall of the well bore. Sensor and communication means 8 for monitoring is arranged in the test chamber 4 for detecting possible leaks into the test chamber 4 from either primary barrier 1 or secondary seal 2. Sensor and communication means 9 is positioned above the secondary seal 2.

Information about measurements from the test chamber 4 and information about measurement(s) above the secondary seal 2 are transferred to a memory device, such as a digital memory, and/or the information is transmitted to a top side or remote location using a suitable way of communication for carrying out this procedure. For instance employing on wireline or using an wireless transmission system on pipe.

Initially the secondary seal 2 is tested and verified prior to the testing of the primary barrier 1. FIG. 2 illustrates the testing of the secondary seal 2 by increasing the pressure of the fluid above the secondary seal 2 and all the way up to the top of the well bore where the well opening 3 is located. Various pressure testing equipment may be provided for such pressure testing of the secondary seal 2, for instance a pressure increasing device (not shown) may be employed to provide predetermined test pressure TP1 by increasing the pressure above the secondary seal 2.

The integrity of the secondary seal 2 is then to be verified before carrying out a testing of the primary barrier. The verification of the integrity of the secondary seal 2 is based on monitoring the information representing the pressure of the test chamber 4 by a monitoring arrangement which comprises the sensor means 8. If no pressure increase is detected by the sensor means 8 arranged below the secondary seal 2, the secondary seal is confirmed sealingly intact. All information can be brought to the topside surface for instance by employing a wireline or using a wireless transmission system.

If a pressure rise is detected by the sensor means 8 according to the test above, a leakage through the secondary seal 2 is discovered. In the case of a leakage scenario a reinstallation procedure needs to be implemented to remedy the leakage and ensure sufficient sealing engagement of the secondary seal 2 in the well. In the case where the secondary seal 2 is for instance a re-settable element, the element is released from installation position in the well and then need to be set again.

When the integrity of the secondary seal 2 is verified, the conditions are set for exposing the primary barrier 1 to a predetermined test pressure TP2 as illustrated in FIG. 3. Initially the pressure of the testing chamber 4 is corresponding to the pressure of the fluid column and installation effects from the secondary sealing device 2.

The basic principle of one or more embodiments of the invention may be to alter the pressure applied to the top installed barrier 1 in the testing chamber 4. This to provide a net force working in the direction of the flow in the well, namely towards the well opening.

The pressure difference is determined to correspond with the local regulators and/or asset owners requirements for well abandonment.

In order to provide the necessary pressure difference, the pressure in the testing chamber 4 needs to be reduced to the predetermined test pressure TP2. For this purpose a pressure reducing device is configured for reducing the pressure of the test chamber 4 to a predetermined test pressure TP2. To establish the predetermined test pressure TP2 a calculation need to be made based on the test load requirement (for instance a pressure such as fluid pressure or other kind of loads acting on the primary barrier from below) and fluid properties.

Various arrangements or pressure testing device such as pressure reducing devices may be employed in order to reduce the pressure of the test chamber 4 to a predetermined test pressure TP2. To reduce the pressure of the test chamber to the predetermined test pressure TP2, the size of the volume of fluid to be removed from the test chamber volume may in accordance with one or more aspects of the invention be calculated to arrive at the predetermined test pressure TP2.

When a tubular intervention method is used to install secondary seal 2, the reduction of pressure in the test chamber 4 may be carried out by the withdrawing of a mechanical component (not shown) such as a small probe from the test chamber 4, thereby withdrawing a part of the volume from the test chamber and reducing the pressure of the of the test chamber 4 to a predetermined test pressure (TP2). This piston may be part of a piston/cylinder assembly and the withdrawing piston may for instance be arranged with pressure or mechanical intensifying properties to enhance the withdrawal effect of the piston for the significant reduction of forces needed to reduce the pressure in the test chamber 4.

An alternative approach to the pressure reducing device for carrying out the pressure reduction of the test chamber 4 to a predetermined test pressure TP2 might comprise a locally installed pump positioned in proximity to the well and in fluid communication with the test chamber 4 for reducing the existing pressure in the test chamber 4 to predetermined test pressure TP2 by the pumping action of the pump.

A further option for provision of the pressure reducing device is to include a tank 13 provided with a chamber filled with a gas at preset pressure, for instance 1 atmospheric pressure (1 bar), when installing the secondary seal 2. In order to arrive at the predetermined test pressure TP2 the chamber volume of the tank 13 is calculated based on the existing volume of the test chamber 4. When opening the chamber of the tank 13 for establishing fluid communication between the chamber of the tank 13 and the existing volume of the test chamber 4, the presence of the gas volume of the tank chamber with a preset pressure for instance 1 atmospheric pressure (1 bar), reduces the pressure of the test chamber 4 to the predetermined test pressure TP2.

To establish fluid communication between the chamber of the tank 13 and the test chamber 4, the tank 13 may be provided with a controllable opening or passage for exteriorly access to the chamber. The tank wall need to be constructed to withstand the differential pressure exerted on the tank during the submerged lowering of the tank to the installation position in the well. The tank may be installed along with the secondary seal 2. After the secondary seal 2 is tested and verified, the access through the opening or the passage of the tank may be controlled by a closing device which may be opened for instance by a remotely controlled operation for reducing the pressure of the test chamber 4 to a predetermined test pressure TP2.

The position of the secondary seal 2 is selected to provide a predetermined test chamber volume with a size suitable for arriving at the predetermined test pressure TP2 when employing the pressure reducing arrangements as described previously.

After the pressure reduction in the pressure test chamber 4 has been carried out to provide the necessary pressure conditions/force differential over the primary barrier 1, the pressure of the test chamber 4 is monitored to check for leakage from the primary barrier 1. Alternatively, these two operations may be carried out essentially at the same time.

The verification of the integrity of the primary barrier 1 is based on monitoring the pressure of the test chamber 4 by a suitable monitoring arrangement arranged for surveying the pressure of the test chamber 4 after/during the pressure reduction. The monitoring arrangement may for instance comprise the sensor means 8, 9. If no pressure increase is detected by the sensor means 8 arranged below the secondary seal 2, the primary barrier 1 is confirmed sealingly intact. All information can be brought to surface for instance by employing a wireline or using a wireless transmission system.

Figure 4:
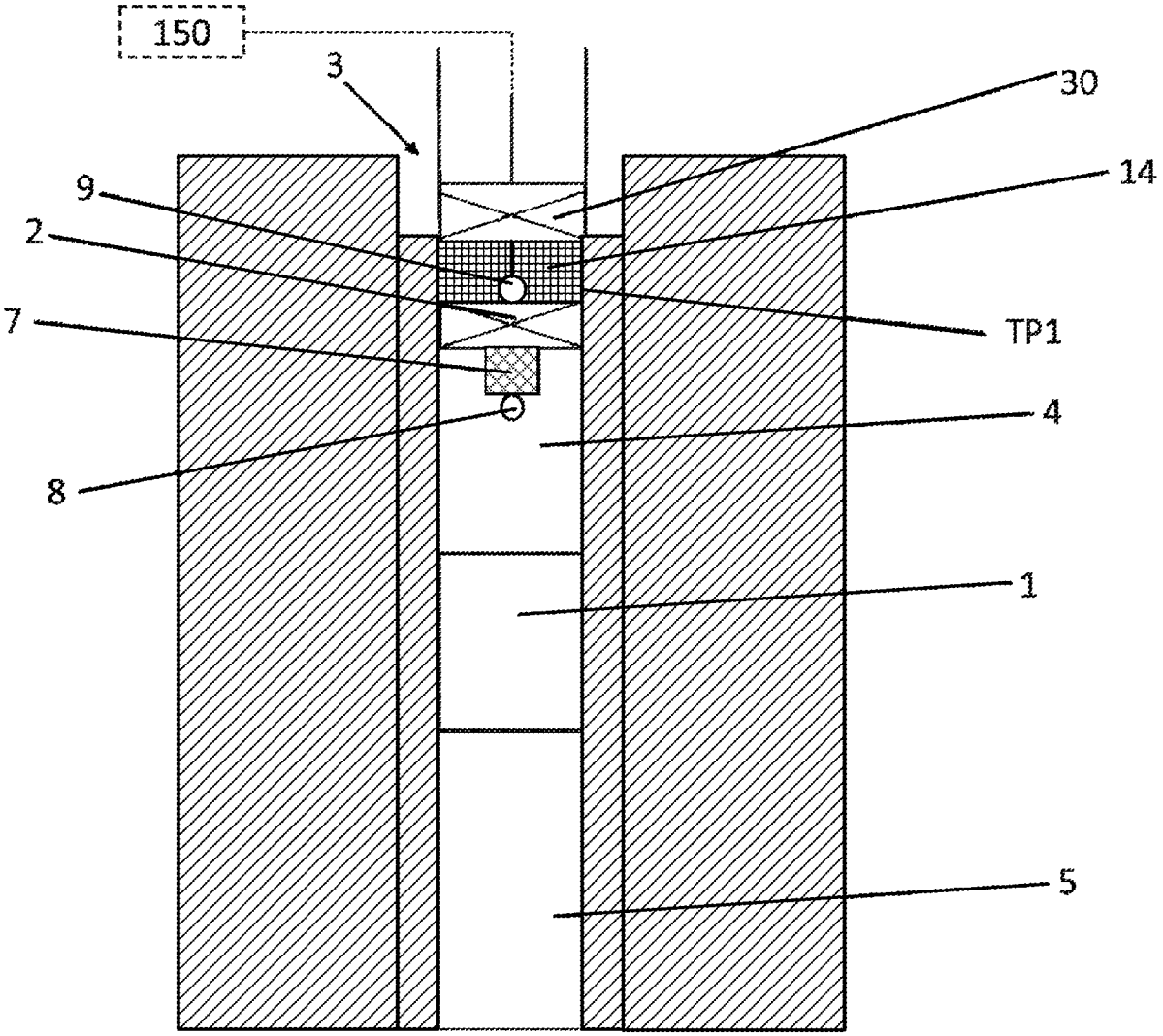
FIG. 4 is a cross sectional side view illustrating pressure testing of a primary barrier over a casing removal and cement squeeze type installed primary barrier, where the secondary seal is provided with an additional test seal for pressure testing of the secondary seal, to avoid extra unwanted load in the well above the secondary seal.
Figure 5:
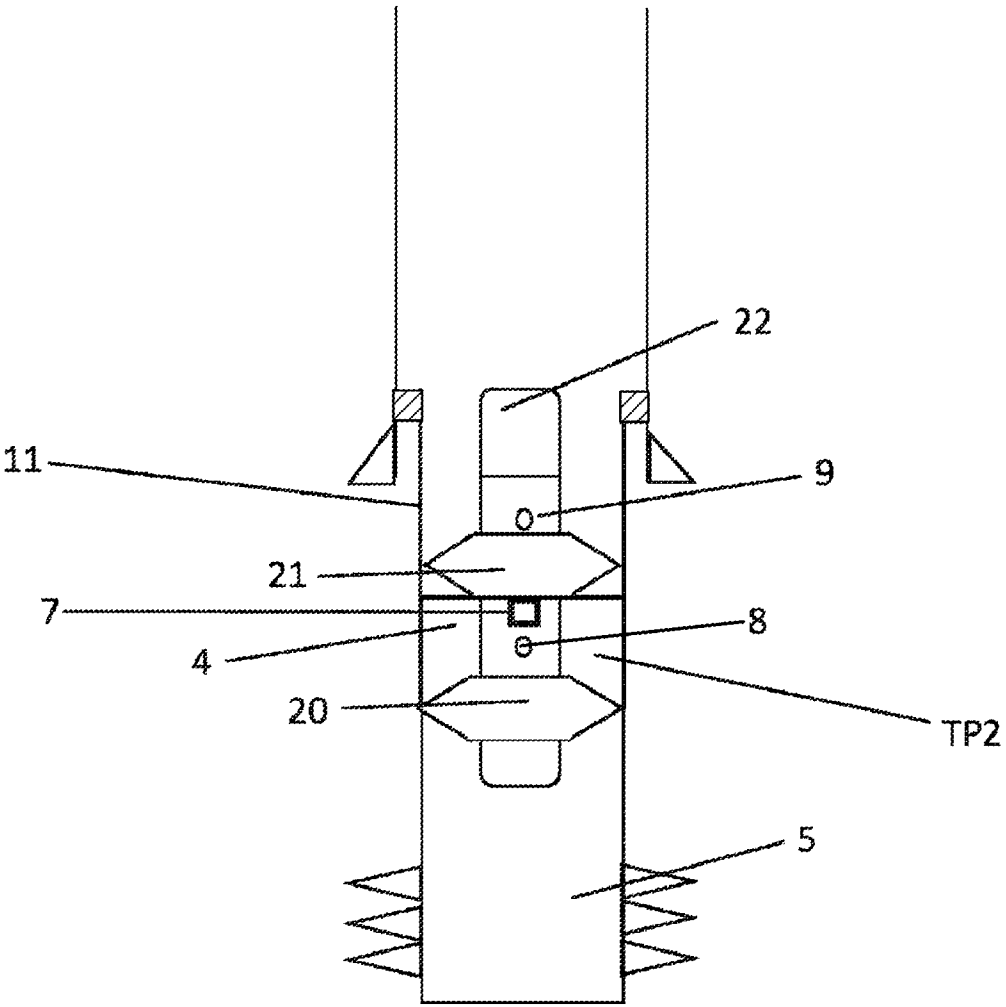
FIG. 5 is a cross sectional side view illustrating the primary barrier and secondary seal provided as radially expandable elements arranged on a removable plug connected to a setting tool.

FIG. 5 shows one or more embodiments where the primary barrier 1 is not provided as 3 permanent barrier as cement or other conventional sealing structures but as a mechanical barrier that may be releasably engaged with an inner wall 11 of a pipe for instance a casing, arranged in the well. The primary barrier 1 then comprises a first radial expandable element 20 and the secondary seal comprises a second radial expandable element 21. The second radial expandable seal 21 may also be releasably engaged with the inner wall 11. In FIG. 5 a setting tool is shown for installation of the first and second radial expandable element 20, 21 in the well. Similar to the configuration as shown in FIG. 1-4, the test chamber 4 is located between primary barrier here provided as the first radial expandable element 20 (primary barrier) and the secondary seal here provided the second radial expandable element 21. The testing follows the procedural steps as described above for one or more embodiments as shown in FIG. 1-3; first arranging the second radial expandable element 21 (secondary seal) above the first radial expandable element 20 (primary barrier) in a position axially spaced from the primary barrier to establish a test chamber 4 confined by the second radial expandable element 21 and the first radial expandable element 20. Then testing and verifying the integrity of the second radial expandable element 21 (secondary seal) following the procedures of the testing of the secondary seal 2 as explained in connection with FIG. 1-3. A pressure increasing device may be employed for testing the integrity of the second radial expandable element 21 from above. When the integrity of second radial expandable element 21 is verified the first radial expandable element 20 is to be tested. The pressure of the test chamber 4 is reduced to a predetermined test pressure TP2 by employing a pressure reducing device for instance one of the three arrangements as mentioned when describing FIG. 1-3, such as installing a tank 13 provided with a chamber filled with gas at preset pressure for instance 1 atmospheric pressure (1 bar), withdrawal of a mechanical component or a locally installed pump. After reducing the pressure to the predetermined test pressure TP2, then monitoring the pressure of the test chamber 4 by a monitoring arrangement and reporting to the top side location about the verification status of the first radial expandable element 20 (primary barrier). Similar to the one or more embodiments shown in FIG. 1-3, the monitoring arrangement may comprise sensor means 8. If no pressure increase is detected by the sensor means 8 arranged below the secondary seal here shown as the second radial expandable element 21, the secondary seal is confirmed sealingly intact. All information can be brought to surface for instance employing a wireline or using a wireless transmission system as explained in connection with FIG. 1-3.

When testing the secondary seal 2 in accordance with one or more embodiments shown in FIG. 1-4, a test pressure needs to be applied working on the volume above the secondary seal 2 and up to the well opening 3. As some of the wells to be tested are old and degraded, it would be advantageous to enable the pressure testing of the secondary seal 2 only in a restricted portion of the well, to reduce the risk of leakage from the full well length.

FIG. 4 illustrates one or more embodiments where only a portion of the well above the secondary seal 2 is subjected to testing. An additional test seal 30 is arranged above the secondary seal 2 to stablish an enclosed test chamber 14.

The secondary seal 2 may be provided by a first radial expandable element 20 similar to the one shown in FIG. 5 and the additional test seal may comprise a second radial expandable element 21 as shown in FIG. 5. Further the first radial expandable element 20 and second radial expandable element 21 may also be arranged on a setting tool 22 for well installation as shown in FIG. 5.

Now the integrity of additional test seal 30 is verified with the secondary seal 2 in one test.

The pressure of the secondary test chamber 14 is reduced to a predetermined test pressure TP1 by employing a pressure reducing device (not shown) for instance one of the three arrangements as mentioned when describing FIG. 1-3, such as an installed tank provided with a chamber filled with gas at preset pressure for instance 1 atmospheric pressure (1 bar), withdrawal of a mechanical component or a locally installed pump. Alternatively, the pressure of the secondary test chamber 14 is increased to a predetermined test pressure, by employing a pressure increasing device (not shown). After reducing or increasing the pressure to the predetermined test pressure TP1, the pressure of secondary test chamber 14 is being by surveyed by a monitoring arrangement and reporting to the top side.

The one or more embodiments in FIG. 4 illustrates the primary barrier 1 as a permanent barrier, but as the skilled person will understand the primary barrier 1 may be provided by different structures both of permanent and more temporary nature such as a mechanical element. In one or more embodiments expandable elements as shown with the setting tool in FIG. 5 may be employed and the setting tools may then be provided with three expandable element: an upper element functioning as an additional test seal, a lower element as a secondary seal and a lowermost element as a primary barrier.

The one or more embodiment of FIG. 3 have one disadvantage, which is that it is difficult to detect if a leak is occurring from below due to a faulty primary barrier 1 or if the leak is occurring from above due to not correctly set seal 2. As described above, the entire well can be pressurized to test the seal 2 from above. In some wells that is not possible due to pressure limitations of the tubing or the formation.

As described above, it is also possible in the one or more embodiments of FIG. 4 to increase or decrease the pressure in the chamber 14.

Figure 6:
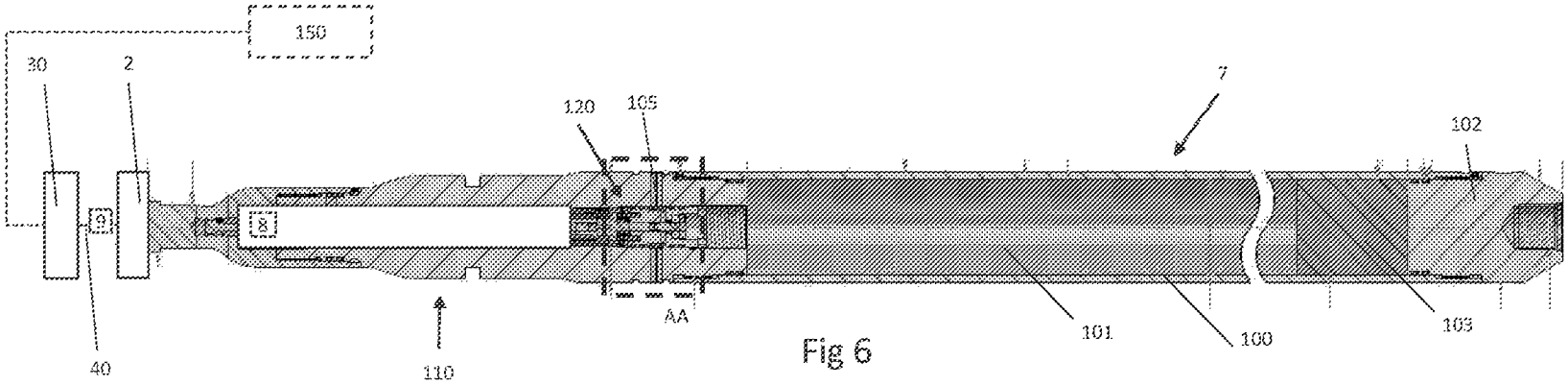
FIG. 6 is a cross sectional view illustrating the system for testing the integrity of a primary barrier in a well, where one or more embodiments of the pressure reducing device is shown in detail.

It is now referred to FIG. 4 and FIG. 6.

First, it should be noted that the terms "barrier" and "seal" may be used interchangeably for a body which purpose is to prevent well fluid from exiting the well. Hence, the seal 2 in FIG. 4 serves the purpose of a secondary seal or barrier above the first barrier. However, as the secondary barrier 2 used for pressure testing in the present application is retrievable, the term "first sealing device" has been used in the description below with respect to reference number 2. For the same reason, the term "second sealing device" has been used in the description below with respect to reference number 30.

Moreover, it should be noted that the term "atmospheric pressure" has been used in the description above and below with to the pressure reducing device. This so-called atmospheric pressure is achieved by having a tank which is opened and then closed topside before the well operation starts, or during manufacturing etc. Hence, the atmospheric pressure typically corresponds to the air pressure surrounding the well tool at the time when the tank becomes closed. It is well known that the atmospheric pressure typically varies dependent on the height above sea level, where the atmospheric pressure is 1 bar at sea level. When the well tool is lowered into an oil and/or gas well, the fluid pressure in the well will be substantially higher than the pressure in the tank. Hence, variations in the so-called atmospheric pressure is neglectable with respect to the fluid pressure in the well.

In FIGS. 4 and 6, one or more embodiments of the system 19 is shown. The system 19 comprises a first sealing device 2 provided for arrangement above the primary barrier 1 in a position axially spaced from the primary barrier 1 for establishing a confined test chamber 4 between the first sealing device 2 and the primary barrier 1.

A second sealing device 30 is provided for arrangement above the first sealing device 2 in a position axially spaced from the first sealing device 2 for establishing a further confined test chamber 14 between the first sealing device 2 and the second sealing device 30.

These first and second sealing devices 2, 30 can be prior art plugging devices, such as the Interwell HEX plug, the Interwell ME plug or other products able to seal of a section of the well pipe.

It should be noted that the environment in which the first sealing device 2 and the second sealing device 30 have been set in, such as the casing 11, is considered as a part of that confinement defining the chambers 4, 14.

In FIG. 6, it is shown that the system 19 comprises a pressure reducing device 7 connected below the first sealing device 2. The purpose of the pressure reducing device 7 is to reduce the pressure of the test chamber 4 to a predetermined test pressure TP2.

The pressure reducing device 7 comprises a fluid tank housing 100 with a fluid compartment 101. A fluid line 105 is provided in the housing 100 with the purpose of providing fluid communication between the outside of the housing 100 and the fluid compartment 101. A valve arrangement 120 is provided in the fluid line 105 for opening and closing the fluid line 105.

The pressure reducing device 7 further comprises a nose section 102 releasably connected to the housing 100 for providing access to the fluid compartment 101. In FIG. 6 it is shown a volume reducing insert 103 which has been inserted into the fluid compartment 101 for reducing the volume of the fluid compartment 101. Hence, various inserts or various numbers of inserts 103 can be used to adjust the volume of the fluid compartment 101. Hence, the same volume reducing device 7 can be re-used for the same operation in another well needing another size of volume of the fluid compartment 101.

The fluid compartment 101 is filled with a gas with atmospheric pressure, which is done topside by closing the valve arrangement 120 and then closing the nose section 102, thereby sealing off the fluid compartment 101 from its surroundings. Hence, when lowered into the well, the pressure inside the compartment 101 is substantially lower than the well pressure.

The valve arrangement 120 will now be described with reference to FIGS. 7*a* and 7*b*. The valve arrangement 120 comprises a substantially T-shaped valve body 121 which in FIG. 7*a* is protruding into the fluid line 105 and seals off the fluid communication between the fluid compartment 101 and the fluid line 105. The valve body 121 is spring-biased by means of a spring 122 in a direction away from the fluid line 105. The movement of the valve body 121 is prevented by pivotable fingers 124, which again are prevented from pivoting by means of an axially displaceable sleeve 126.

Figure 7B:
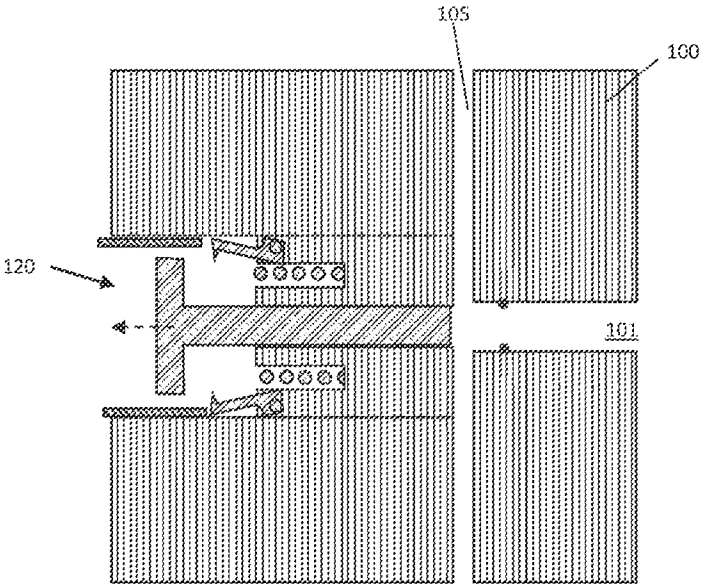
FIG. 7*b* shows the valve in FIG. 7*a* in its open state.
Figure 7A:
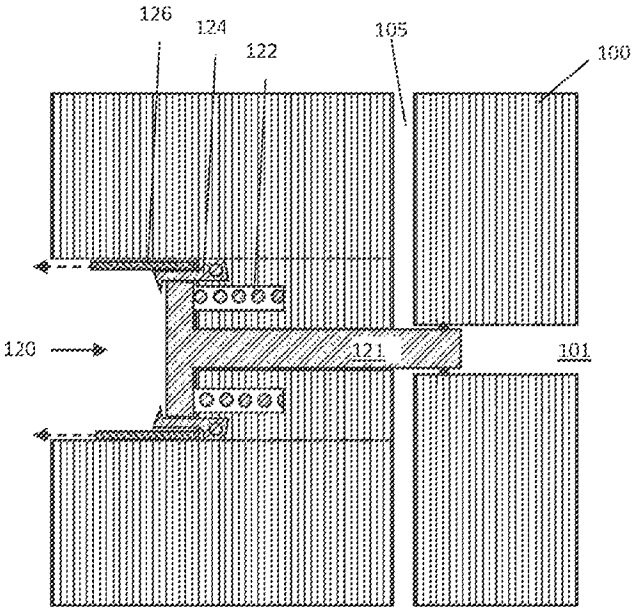
FIG. 7*a* shows details of the dashed box AA of FIG. 6, where the valve is in its closed state.

In FIG. 7*b* it is shown that the sleeve 126 has been axially displaced away from the fingers 124, allowing them to pivot to a position in which the axial movement of the valve body 121 is not prevented, and the valve body 121 has been displaced to a position in which fluid can enter the fluid compartment 101.

The pressure reducing device 7 further comprises a control unit 110 for controlling the valve arrangement 120. The control unit 110 is considered prior art and can be a Interwell HSU tool (Hydrostatic Setting Unit).

The system 19 further comprises a monitoring arrangement having a first sensor and communication device 8 arranged for surveying the pressure of the test chamber 4 after the pressure reduction and a second sensor and communication device 9 arranged for surveying the pressure of the further test chamber 14 after the pressure reduction. The first sensor and communication device 8 is provided as a part of the control unit 110, while the second sensor and communication device 9 can be connected either above the first sealing device 2 or below the second sealing device 30.

The system 19 further comprises a pressure testing device 150 provided in communication with the first and second sensor and communication devices 8, 9. The pressure testing device 150 is configured for testing and verifying the integrity of the first sealing device 2 and the integrity of the primary barrier 1. The control unit 110 can also be controlled by the topside pressure testing device 150.

In the above system 19, the pressure testing device 150 is configured to verify the integrity of the primary barrier 1 if the following conditions are fulfilled:

no pressure increase is detected in the test chamber 4 after the applied pressure reduction; and no pressure decrease is detected in the further test chamber 14 after the applied pressure reduction.

In the same way, the pressure testing device 150 is configured to verify a failed integrity of the primary barrier 1 if a pressure increase is detected in the test chamber 4 after the applied pressure reduction, i.e. indicating that a leak is present either through the first sealing device 2 or the primary barrier 1. The pressure testing device 150 is also configured to verify a failed integrity of the second sealing device 30 if a pressure decrease is detected in the further test chamber 14 after the applied pressure reduction. If one of these barriers are verified to be failed, then the test must be performed again, by resetting the first and second sealing devices 2, 30.

In the one or more embodiments of FIG. 6, the first sealing device 2 and the pressure reducing device 7 is set in a first setting operation and then the second sealing device 30 is set in a subsequent second setting operation. Here, the first and second sealing devices 2, 30 are not mechanically connected to each other.

However, it is also possible that the entire system 19 is mechanically connected as one unit which is set in one setting operation. As shown in FIG. 6, the first and second sealing devices 2, 30 can be mechanically connected to each other by means of a mechanical connection 40.

It should be noted the pressure testing device 150 can be provided in communication with the second sealing device 30 by means of a wired communication wire, typically e-line. The second sealing device 30 may comprise a wireless communication unit, which are communicating wirelessly with the first and second pressure and communication means 8, 9 and also with the control unit 110 for controlling the valve arrangement 120. Alternatively, a wired connection can be provided through the first and second sealing devices 2, 30 to the means 8, 9 and the control unit 110.

It should be noted that the above verification process is performed by monitoring one or more pressures during a predetermined time period and then draw a conclusion based on the monitored pressure(s) regarding whether or not the monitored pressure(s) are within predetermined boundaries.

According to the above, it is achieved that the separate operation of pressure testing of the further test chamber, either by increasing the pressure in the further test chamber or by decreasing the pressure in the further test chamber, can be avoided.

When the test has been performed, the system 19 can be retrieved (either in one or in several operations) and can be reused for testing of other well barriers by emptying the compartment 101 and providing atmospheric pressure in the compartment 101 again.

The invention claimed is:

1. A method for testing an integrity of a primary barrier arranged in a well, wherein the method comprises:

arranging a first sealing device above the primary barrier in a position axially spaced from the primary barrier in the well, thereby establishing a test chamber confined by the first sealing device and the primary barrier;

arranging a second sealing device above the first sealing device in a position axially spaced from the first sealing device in the well, thereby establishing a further test chamber between the first sealing device and the second sealing device;

reducing a pressure of the test chamber to a predetermined test pressure;

monitoring the pressure of the test chamber and a pressure of the further test chamber after the pressure reduction; and verifying the integrity of the primary barrier if the following conditions are fulfilled:

no pressure increase is detected in the test chamber after the applied pressure reduction; and no pressure decrease is detected in the further test chamber after the applied pressure reduction.

2. The method according to claim 1, where the method further comprises retrieving the first sealing device and the second sealing device from the well after verifying the integrity of the primary barrier.

3. The method according to claim 1, where reducing the pressure of the test chamber comprise:

providing the first sealing device with a tank device having a chamber filled with a gas with a pressure lower than a pressure in the well; and establishing fluid communication between the chamber of the tank device and the test chamber.

4. The method according to claim 3, where providing the first sealing device with a tank device having a chamber filled with a gas with a pressure lower than the pressure in the well comprises:

establishing fluid communication between the chamber of the tank device and topside surroundings, before the first sealing device is lowered into the well; and closing the fluid communication to a chamber topside, before the first sealing device is lowered into the well.

5. The method according to claim 1, where the method further comprises:

verifying a failed integrity of the second sealing device if a pressure decrease is detected in the further test chamber after the applied pressure reduction.

6. A system for testing integrity of a primary barrier arranged in a well; wherein the system comprises:

a first sealing device provided for arrangement above the primary barrier in a position axially spaced from the primary barrier for establishing a confined test chamber between the first sealing device and the primary barrier;

a second sealing device provided for arrangement above the first sealing device in a position axially spaced from the first sealing device for establishing a further confined test chamber between the first sealing device and the second sealing device;

a pressure reducing device configured for reducing a pressure of the test chamber to a predetermined test pressure;

a monitoring arrangement comprising a first sensor and communication device arranged for surveying the pressure of the test chamber after the pressure reduction and a second sensor and communication device arranged for surveying a pressure of the further test chamber after the pressure reduction; and a pressure testing device provided in communication with the first and second and communication devices, where the pressure testing device is configured for testing and verifying an integrity of the first sealing device and the integrity of the primary barrier.

7. The system according to claim 6, where the pressure testing device is configured to verify the integrity of the primary barrier if the following conditions are fulfilled:

no pressure increase is detected in the test chamber after the applied pressure reduction; and no pressure decrease is detected in the further test chamber after the applied pressure reduction.

8. The system according to claim 6, where the pressure reducing device comprises:

a fluid tank housing with a fluid compartment;

a fluid line providing fluid communication between an outside of the fluid tank housing and the fluid compartment; and a valve arrangement provided in the fluid line.

9. The system according to claim 8, where the pressure testing device is configured to control the valve arrangement.

10. The system according to claim 8, where the pressure reducing device comprises:

a nose section releasable connected to the fluid tank housing for providing access to the fluid compartment; and a volume reducing insert into the fluid compartment for reducing the volume of the fluid compartment.

11. The system according to claim 8, where the fluid compartment is filled with gas with atmospheric pressure before an integrity testing operation starts.

12. The system according to claim 6, where the first and second sealing devices are mechanically connected to each other and are set during one run.

13. A method for testing an integrity of a primary barrier arranged in a well, wherein the method comprises:

arranging a first sealing device above the primary barrier in a position axially spaced from the primary barrier in the well, thereby establishing a test chamber confined by the first sealing device and the primary barrier;

arranging a second sealing device above the first sealing device in a position axially spaced from the first sealing device in the well, thereby establishing a further test chamber between the first sealing device and the second sealing device;

reducing a pressure of the test chamber to a predetermined test pressure comprising:

providing the first sealing device with a tank device having a chamber filled with a gas with a pressure lower than a pressure in the well; and establishing fluid communication between the chamber of the tank device and the test chamber;

monitoring the pressure of the test chamber and a pressure of the further test chamber after the pressure reduction; and verifying the integrity of the primary barrier if the following conditions are fulfilled:

no pressure increase is detected in the test chamber after the applied pressure reduction; and no pressure decrease is detected in the further test chamber after the applied pressure reduction.

14. A system for testing an integrity of a primary barrier arranged in a well; wherein the system comprises:

a first sealing device provided for arrangement above the primary barrier in a position axially spaced from the primary barrier for establishing a confined test chamber between the first sealing device and the primary barrier;

a second sealing device provided for arrangement above the first sealing device in a position axially spaced from the first sealing device for establishing a further confined test chamber between the first sealing device and the second sealing device;

a pressure reducing device configured for reducing a pressure of the test chamber to a predetermined test pressure, wherein the pressure reducing device comprises: a fluid tank housing with a fluid compartment; a fluid line providing fluid communication between an outside of the fluid tank housing and the fluid compartment; and a valve arrangement provided in the fluid line;

a monitoring arrangement comprising a first sensor and communication device arranged for surveying the pressure of the test chamber after the pressure reduction and a second sensor and communication device arranged for surveying a pressure of the further test chamber after the pressure reduction; and a pressure testing device provided in communication with the first and second and communication devices, where the pressure testing device is configured for testing and verifying an integrity of the first sealing device and the integrity of the primary barrier.

* * * * *